US007654421B2

(12) United States Patent
Chan et al.

(10) Patent No.: US 7,654,421 B2
(45) **Date of Patent: *Feb. 2, 2010**

(54) AUTOMATICALLY CONFIGURABLE CHEMICAL DOSING APPARATUS FOR CLEANING EQUIPMENT

(75) Inventors: Wai Yin Cedric Chan, Santa Cruz, CA (US); Andrew John Cocking, Ben Lomond, CA (US); William Edward Simpson, New Berlin, WI (US); Douglas Thomas Story, Racine, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 524 days.

This patent is subject to a terminal disclaimer.

(21) Appl. No.: 11/444,869

(22) Filed: Jun. 1, 2006

(65) Prior Publication Data

US 2007/0044819 A1 Mar. 1, 2007

Related U.S. Application Data

(60) Provisional application No. 60/712,369, filed on Aug. 30, 2005.

(51) Int. Cl.
*A47L 15/46* (2006.01)

(52) U.S. Cl. ..... 222/651; 222/52; 340/572.1; 340/10.1; 340/10.3

(58) Field of Classification Search ..... 222/651, 222/52, 63, 23, 32, 64–66; 134/1, 18, 56 R; 235/375–385; 340/612, 572.1–572.9, 10.1–10.6
See application file for complete search history.

(56) References Cited

U.S. PATENT DOCUMENTS

| | | | | |
|---|---|---|---|---|
| 4,925,444 | A | 5/1990 | Orkin et al. | |
| 4,964,185 | A | 10/1990 | Lehn | |
| 5,014,211 | A | 5/1991 | Turner et al. | |
| 5,203,366 | A | 4/1993 | Czeck et al. | |
| 5,246,026 | A | 9/1993 | Proudman | |
| 5,435,157 | A | 7/1995 | Laughlin | |
| 5,448,499 | A | 9/1995 | Palmer | |
| 5,738,153 | A * | 4/1998 | Gerling et al. | 141/83 |
| 5,826,749 | A | 10/1998 | Howland et al. | |
| 5,969,970 | A | 10/1999 | Rhoades | |
| 6,119,434 | A | 9/2000 | Andersson | |
| 6,322,242 | B1 | 11/2001 | Lang et al. | |
| 6,792,637 | B2 | 9/2004 | Reichold et al. | |
| 7,152,781 | B2 * | 12/2006 | O'Dougherty et al. | 235/376 |
| 7,173,528 | B1 * | 2/2007 | Stewart et al. | 340/572.3 |

(Continued)

FOREIGN PATENT DOCUMENTS

DE 201 15 173 U1 9/2001

(Continued)

*Primary Examiner*—Kevin P Shaver
*Assistant Examiner*—Robert K Nichols, II
(74) *Attorney, Agent, or Firm*—Quarles & Brady LLp; George E. Haas

(57) ABSTRACT

A dispensing system responds to reading data stored on a container by determining a dose for a chemical stored in that container. Then each time that the chemical is to be fed into a cleaning machine, the dispensing system operates a flow control device to deliver the designated dose. Thus the dispensing system is automatically reconfigured when different concentrations of the chemical are supplied to the dispensing system. Various mechanisms for storing the data on and reading the data from the container are described.

10 Claims, 4 Drawing Sheets

U.S. PATENT DOCUMENTS

| | | | | |
|---|---|---|---|---|
| 2001/0001131 | A1 | 5/2001 | Miller | |
| 2003/0116177 | A1 | 6/2003 | Appel et al. | 134/18 |
| 2003/0174046 | A1 | 9/2003 | Abrams | 340/5.92 |
| 2004/0041709 | A1* | 3/2004 | Forster | 340/603 |
| 2004/0124988 | A1* | 7/2004 | Leonard et al. | 340/612 |
| 2004/0140013 | A1 | 7/2004 | Yacko et al. | |
| 2005/0247742 | A1 | 11/2005 | Livingston et al. | |
| 2006/0080819 | A1* | 4/2006 | McAllister | 29/403.3 |
| 2006/0119484 | A1* | 6/2006 | Chishima et al. | 340/612 |
| 2007/0034236 | A1* | 2/2007 | Reichold | 134/18 |

FOREIGN PATENT DOCUMENTS

| | | | |
|---|---|---|---|
| DE | 201 15 173 | U1 | 11/2001 |
| FR | 2 536 184 | | 11/1983 |
| FR | 2 536 184 | A1 | 5/1984 |
| WO | WO 02/020893 | A | 3/2002 |
| WO | WO 02/20893 | A1 | 3/2002 |

* cited by examiner

AUTOMATICALLY CONFIGURABLE CHEMICAL DOSING APPARATUS FOR CLEANING EQUIPMENT

CROSS-REFERENCE TO RELATED APPLICATIONS

This application claims benefit of U.S. Provisional Patent Application No. 60/712,369 filed on Aug. 30, 2005.

STATEMENT REGARDING FEDERALLY SPONSORED RESEARCH OR DEVELOPMENT

Not Applicable

BACKGROUND OF THE INVENTION

1. Field of the Invention

The present invention relates to cleaning apparatus, such as machines for washing kitchenware or laundry; and in particular to systems for automatically dispensing chemicals used by such cleaning apparatus.

2. Description of the Related Art

Commercial kitchens have equipment to clean and sanitize glassware, dishes, silverware, pot, pans and cooking utensils, which are collectively referred to as "kitchenware." Such equipment, commonly known as a "dishwasher" or more generically as a "warewasher", has a cabinet defining an internal chamber into which trays of kitchenware are placed for washing. A washing and rinsing assembly within the chamber has a plurality of nozzles from which water sprays onto the kitchenware being cleaned. The lower part of the cabinet forms a reservoir that collects the water which is repeatedly circulated through the nozzles by a pump during the wash cycle. Thereafter during a rinse cycle, fresh water from an external supply line is fed through the nozzles. When the rinse water flows into the reservoir, a portion of the reservoir water overflows into a drain thus replacing some of the water from the wash cycle.

At various times during the cleaning process, different chemicals are dispensed from supply containers into the warewasher. These chemicals commonly include a detergent, a rinse additive, and a sanitizer. Conventional warewashing equipment have separate receptacles into which the supply containers are placed, with each receptacle dedicated to only one type of chemical. For example, U.S. Pat. No. 6,322,242 discloses a dispensing system that has separate caps for chemical containers with supply lines running from each cap to the apparatus in which the chemicals are used. Each cap or supply line is color coded to designate the chemical that is dispensed there through. Other types of marking have been used to indicate to employees which chemical container connects to each receptacle.

Chemicals for use in automatic warewashing machines are available from many manufacturers. The same type of chemical, detergent for example, may vary in concentration depending upon the specific manufacturer and even the same manufacturer may produce the same chemical in different concentrations. A lesser amount of a more concentrated chemical is required during each operating cycle than a less concentrated version of the same chemical. Therefore the amount of a chemical to dispense into the warewasher varies depending upon the particular brand.

When switching brands of a chemical, the amount of that chemical to be dispensed during each operating cycle often has to be manually adjusted. However, only a service technician is able to make that adjustment. If the operator used the machine with a different chemical without a required adjustment, either too much chemical was used, which was costly, or too little chemical was used, which did not properly clean the kitchenware.

Therefore, a need still exists for a control system that does not require an operator to adjust the dispenser when a chemical container is changed on a cleaning machine.

SUMMARY OF THE INVENTION

An apparatus is provided for dispensing a chemical into a cleaning machine, wherein the chemical is stored in a container that has data recorded thereon. The apparatus has a dispenser port to receive the chemical from the container. In a preferred embodiment, the port is configured to mate with an outlet on the container. A flow control device, such as a pump or a valve, is connected to the dispenser port and governs the flow of the chemical from the dispenser port to the cleaning machine. A data reader reads the data from the container. A controller, receives the data obtained by the data reader and operates flow control device in response to that data to control an amount of chemical that is dispensed. Thus the dispensing system is automatically reconfigured when different concentrations of the chemical fed into the dispenser port.

Various mechanisms can be used to record the data on the containers. In one case, the data are recorded as indicia on a label and the reader optically senses the indicia. For example, the indicia may be a printed barcode that is read by a conventional barcode scanner. In another case, the data are recorded in a radio frequency tag on the container and the data reader comprises an electronic device that interrogates the radio frequency tag to obtain the data.

In different aspects of the apparatus, the flow control device is operated to control the amount of chemical that is dispensed by controlling one of a length of time that the chemical is dispensed and a rate at which the chemical is dispensed.

An optional feature of the dispensing apparatus is erasing the data from a container that is empty, so that the container cannot be refilled, possibly with a different chemical, and then reused in the machine.

DETAILED DESCRIPTION OF THE INVENTION

The present inventive dispensing system will be described in the context of a warewasher for cleaning kitchenware, however it should be appreciated that this dispensing system can be utilized with other types of cleaning equipment, such as apparatus for washing laundry, cleaning floors, and cleaning vehicles to name but a few examples.

Figure 1:
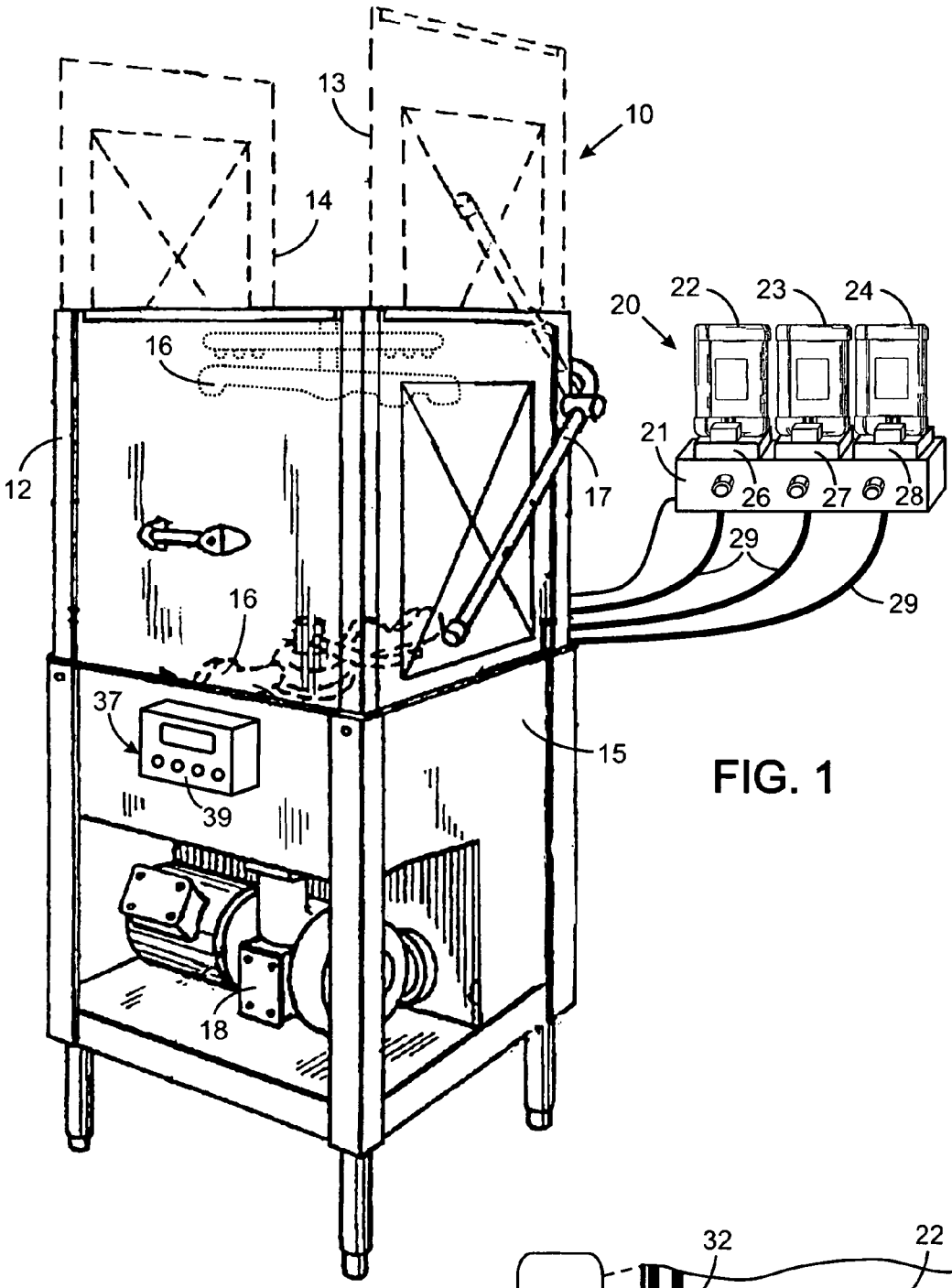
FIG. 1 is an isometric illustration of a commercial warewasher which incorporates the present invention.

With initial reference to FIG. 1, a commercial kitchen warewasher 10 has a cabinet 12 defining a chamber into which kitchenware is placed for washing. Two side doors 13 and 14 are slidably mounted on the cabinet 12 to close openings through which racks of glasses, dishes, utensils, pot and pans pass into and out of the chamber. The side doors 13 and 14 are connected to a link arm 17 so that they operate in unison. The cabinet 12 contains standard washing and rinsing assembly that includes a plurality of nozzles 16 which spray water supplied by a wash pump 18. A region at the bottom of the cabinet 12 forms a reservoir 15 into which the water drains from the kitchenware and which holds a volume of water between washing operations. An overflow drain in the reservoir prevents the water from rising above a given level.

Figure 2:
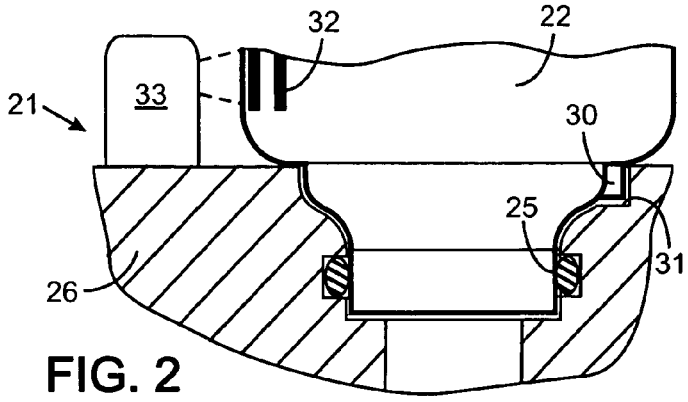
FIG. 2 is a partial sectional drawing showing connection of a chemical container to the dispenser of the warewasher.

A dispensing system 20 is connected to the warewasher 10 to mete out different chemicals into the cabinet 12 at specific times during the cleaning process. The dispensing system 20 has a dispenser 21 that holds three containers 22, 23 and 24 that store a detergent, a rinse additive, and a sanitizer, for example. A different electrically operated pump is provided to feed each liquid chemical from the respective container 22, 23 or 24 through supply tubes 29 to the warewasher cabinet 12. Each container 22, 23 and 24 is inverted so that its neck 25 fits into a separate port 26, 27 and 28 of the dispenser 21 as shown in FIG. 2 with respect to the first port 26 and first container 22. Each container has a key 30 that fits into a keyway 31 of the respective dispenser port, thereby orienting the container so that an indicia 32 on the label faces a data reader 33. It should be understood that the dispensing system 20 can utilize other forms of ports, such as for example the container caps with tubes shown in U.S. Pat. No. 6,322,242 or a reservoir that holds the chemical received from a container.

Figure 3:
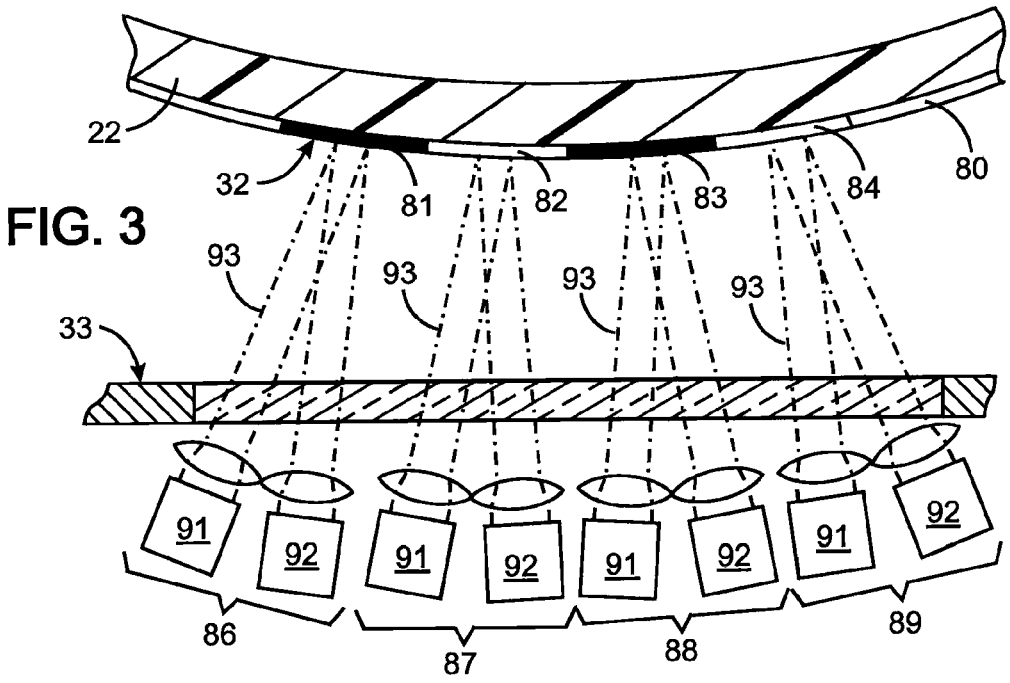
FIG. 3 is a cutaway view of an alternative chemical container and dispenser of the warewasher.

Alternatively, the dispensing system 20 can mete out powdered or granulated chemicals using a dispenser 200 shown in FIG. 3. The chemicals are received in a container 202 with a metering and dispensing closure 204 that is removably supported in a receptacle 206. A water intake conduit 208, controlled by solenoid valve 210, is utilized to introduce water into the receptacle 206, wherein the water mixes with the chemical from the container 202 to produce a solution. A solution outlet conduit 212 also is in communication with the receptacle 206. An electric motor 214 drives a shaft 216 that is journalled in the collar 218 with a seal 220.

Figure 4:
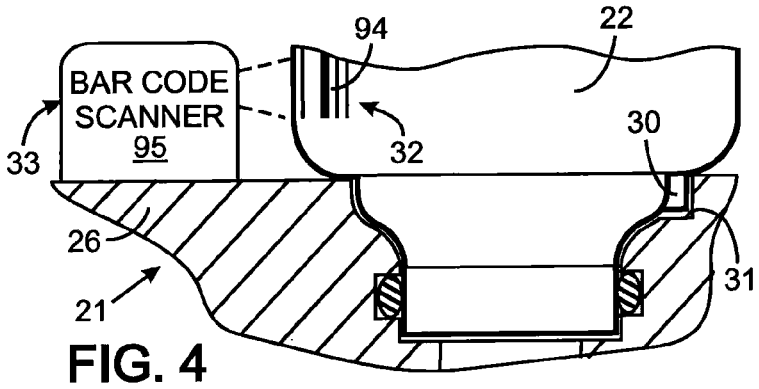
FIG. 4 is an exploded view of components of a metering and dispensing closure on the container in FIG. 3.

Referring to FIG. 4, the metering and dispensing closure 204 is composed of three basic components. There is a cap 222 with an upstanding wall 224 having internal threads for engaging complementary threads on neck of the container 202. A first rotatable disk 226 is seated inside the cap 222 and a second rotatable disk 230 is located on the opposite, outer side of the cap. The first disk 226 has a cutaway portion 228. The second disk 230 has a stub shaft 232 with projections 234 which fit through an opening 236 in the cap 222 in a manner that the projections engage slots 238 in the first disk 226.

Upon being placed into the dispenser 200 as shown in FIG. 3, both disks 226 and 230 are rotated by the shaft 216 upon being driven by the electric motor 214. When that rotation occurs, the powdered or granulated chemical within the container 202 enters a measuring chamber 240 in cap 220 as it is uncovered by the cutaway section 228 of the first disk 226. However, the chemical now is blocked from passing into the receptacle 14 by a solid section of the second disk 230. Further rotation of the closure components causes the first disk 226 to move into a position in which it covers the measuring chamber 240. Additional rotation enables an aperture 242 in the second disk 230 to communicate with the measuring chamber 240, thereby allowing the chemical to flow into receptacle 206 and be mixed with the water. The mixed solution then exits through the solution outlet conduit 212 flowing to the warewasher 10.

Figure 5:
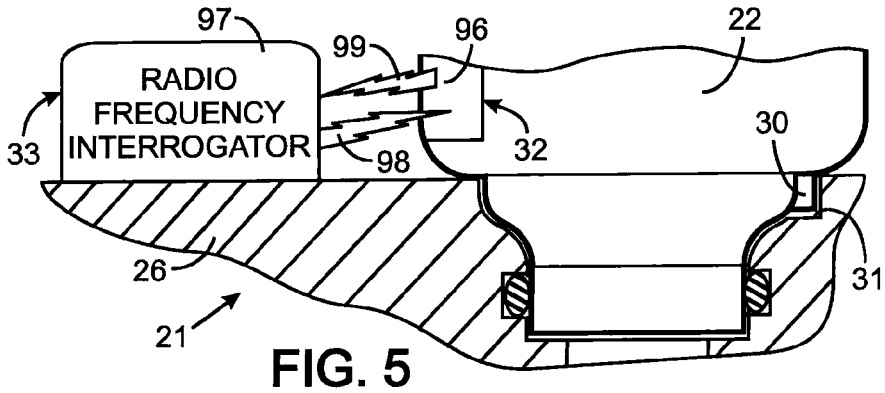
FIG. 5 is a schematic depiction of an optical system for reading indicia located on a chemical container.

Referring again to FIG. 2, a separate data reader 33, 34 and 35 is provided for each port 26, 27 and 28, respectively to read data from the associated container and collectively form a data reader arrangement. The three data readers 33-35 are identical and an exemplary type of data reader is shown in FIG. 5 as the first data reader 33. In this case, the first container 22 has a label 80 with four areas 81, 82, 83 and 84 thereon, which may either be reflective or non-reflective to light. For example, each area may be printed with either white or black ink to define its reflectivity. The reflectivity of each of the four areas 81-84 is used to encode data regarding the particular container 22, and specifically to identify the type of chemical contained therein. With four label areas 81-84, sixteen different types of chemicals can be identified. Therefore, the indicia formed by the four label areas 81-84 can indicate not only the three chemical types (detergent, rinsing agent, or sanitizer), but other characteristic of the general chemical type, such as its concentration.

Figure 6:
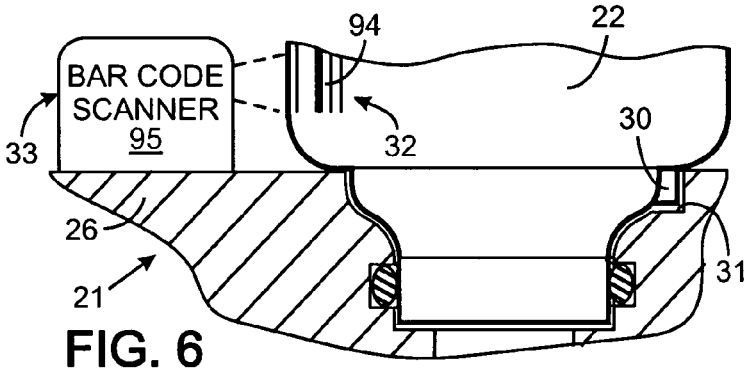
FIG. 6 illustrates a system for reading a barcode located on the chemical container.

The data reader 33 has four separate pairs 86, 87, 88 and 89 of light emitters 91 and detectors 92. Each emitter-detector pair 86-89 is focused on a different one of the label areas 81-84, respectively, to produce a signal that indicates the degree of reflectivity of the associated label, e.g. whether the area is white or black. For example, in the first emitter-detector pair 86, the light emitter 91 transmits a beam 93 of light which is directed toward label area 84 on the container 22. Depending on the reflectivity of the label area, the beam may be reflected back to the associated detector 92. Even a black label area may reflect some light back to the associated detector. The emitter-detector pair may operate at a narrow band of wavelengths (for example in the infrared spectrum) to distinguish the sensing light from ambient light. The intensity of the reflected light is a function of the reflectivity of the associated label area 81. Specifically, a white label area will reflect a greater amount of light than a black label area, thereby producing analog electrical signals of different magnitudes from the detector 92. Therefore by comparing the signals from each light detector 92 to a threshold level, each analog signal is converted into a digital bit that indicates whether the associated label area is white or black. The four digital bits from the plurality of light detectors 92 of the data reader 33 designate the data about the chemical that is encoded by the indicia 32, e.g. one of the sixteen chemical types. Because a black label area reflects some light, the failure of the detectors 92 to sense any reflected light indicates the absence of a container at that particular dispenser port.

Where a need to encode a greater number of chemical types is required, other kinds of data recording mechanisms may be utilized. For example as shown in FIG. 6, a conventional barcode 94 can be utilized as the indicia 32 on container 22. The barcode 94 can encode not only the type of chemical, but other information such as its manufacture date and concentration. In this embodiment, a standard barcode scanner 95 is employed as the first data reader 33.

Figure 7:
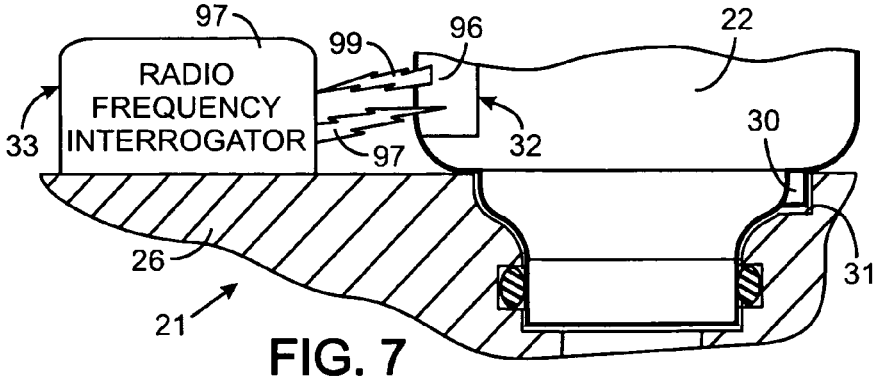
FIG. 7 is a schematic depiction of system for interrogating a radio frequency identification tag located on the chemical container.

There is a trend toward providing radio frequency identification tags on products, thereby enabling the products to be tracked during distribution from manufacturer to the ultimate consumer. Conventional radio frequency tags act as a transponder and respond to being interrogated by a radio frequency (RF) signal by producing a reply signal that carries information identifying the particular piece of merchandise. Such radio frequency identification tags can be utilized on the chemical containers 22-24 as the indicia 32 to identify the particular type of chemical contained therein, the concentration of that chemical, and other product information. As shown in FIG. 7, a radio frequency tag 96 is attached to the first container 22. In this embodiment, the first data reader 33 comprises a conventional RF interrogator 97 that emits a radio frequency signal 98 that is directed toward the container 22. In order to avoid cross-talk between the three data readers 33-35, the transmitted radio frequency signal has a relatively low power so that it does not activate a tag on an adjacent container 23 or 24 within the dispensing system 20. This ensures that the data being read will come from a container within the first dispenser port 26. Upon receiving a signal at the proper frequency from RF interrogator 97, the identification tag 96 returns a reply signal 99 that carries encoded information about the chemical within the first container 22 which the manufacturer stored in the tag. The radio frequency interrogator 97 receives and decodes that reply signal 99 to extract the encoded data.

Figure 8:
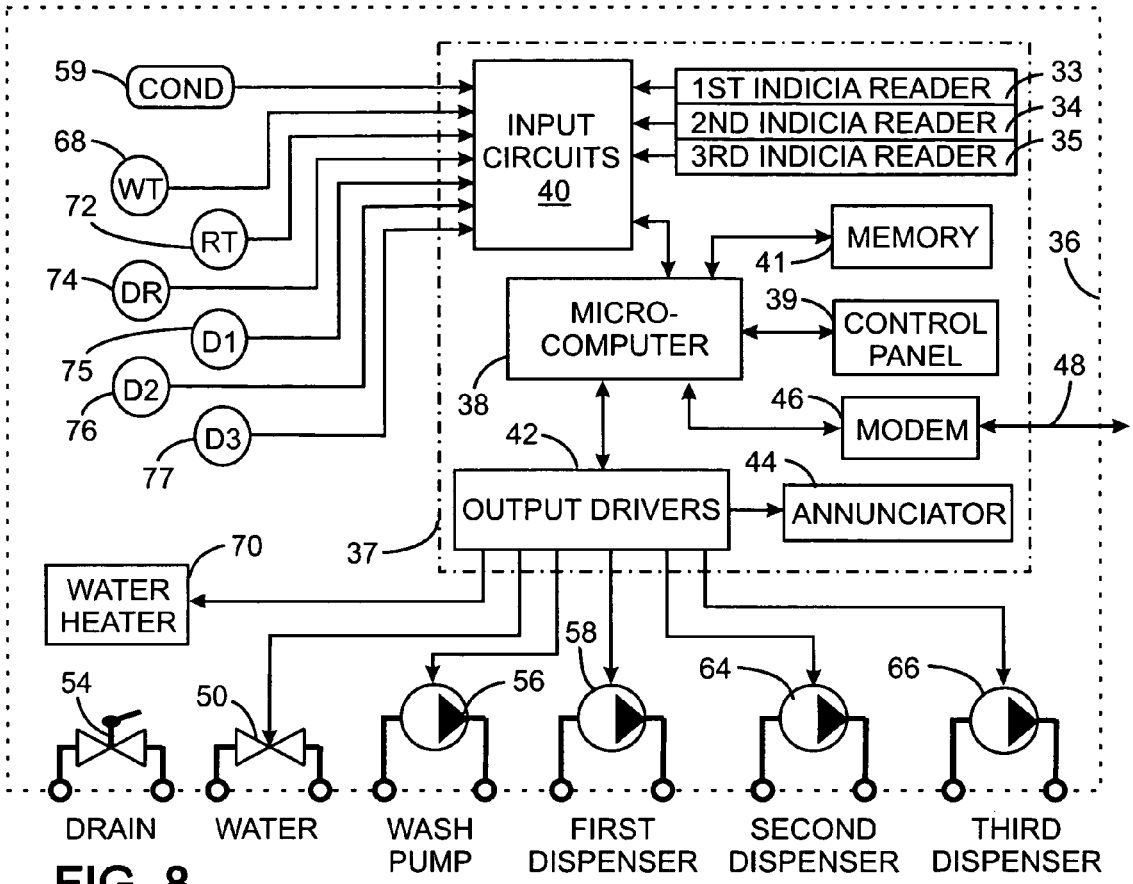
FIG. 8 is a schematically shows the warewasher control circuit.

Referring to FIG. 8, the three data readers 33-35 are part of a control system 36 the governs the operation of the warewasher 10. The control system 36 employs an electronic controller 37 that is based on a microcomputer 38 which executes a software control program stored in a memory 41. The controller 37 includes input circuits 40 that receive signals from the data readers 33-35. Input signals also are received from the operator control panel 39 that has switches by which the human operator starts a cleaning operation and selects operational functions to be performed. The control panel 39 also has devices that provide visual indications of the functional status of the warewasher. A modem 46 is connected to the microcomputer 38 for the exchange of data with other control systems and computers via a computer network 48.

The controller 37 has several output drivers 42, one of which activates an annunciator 44, such as a buzzer or a lamp which produce an audible or visible warning. Another output driver 42 operates a solenoid water valve 50 during the rinse cycle to send fresh water through the nozzles 16. A manually operated supply valve 52 is provided to fill the reservoir 15 at the bottom of the cabinet 12 prior to operating the warewasher 10. A drain valve 54 is manually operated to empty the reservoir 15. Another output of the controller 37 activates the wash pump 56 during the wash cycle. The controller 37 also automatically governs dispensing detergent and additives into the warewasher cabinet 12. Specifically, the microcomputer 38 determines when to activate a detergent pump 58 in response to a signal from a conductivity sensor 59, that is located below the water line of the reservoir 15. Other output drivers 42 operate pumps 64 and 66 to introduce the rinse additive and the sanitizer chemicals into the warewasher cabinet 12 at appropriate times during the cleaning cycle. Alternatively the chemicals can flow to the warewasher cabinet by gravity in which case the pumps 58, 64 and 66 can be replaced by electrically operated valves to control that flow. Such pumps and valves are generically referred to as "flow control devices."

Several different types of sensors can be connected to the input circuits 40 of the controller 37. A water temperature (WT) sensor 68 is located in the reservoir 15 to produce a signal indicating the temperature of the water. The controller 37 responds to that temperature signal by activating a water heater 70 that has a heating element within the reservoir. Another temperature sensor 72 is mounted in a conduit that carries water during the rinse cycle and thus provides an indication of the rinse water temperature (RT) to ensure that the proper water temperature is being maintained. If the rinse water is not at the proper temperature the controller 37 adds the sanitizer chemical from the dispensing system 20. A pair of sensor switches (DR) 74 provide signals indicating when either side door 14 is open and the controller 37 suspends operation in those cases. A set of three sensors 75, 76 and 77 respectively detect when the chemical containers 22, 23 and 24 are empty.

The present invention relates to a mechanism which dispenses chemicals from the dispenser 21 based on the information read from the data recorded on the containers 22-24 placed into the dispenser. Occasionally, the microcomputer 38 reads the data signals from the three data readers 33-35 to determine characteristics of the chemical at each dispenser port 26-28. In the preferred embodiment, the data readers are polled each time a washing operation commences. However, in other cases, the signals from the data readers may be inspected by the microcomputer 38 whenever the operator changes a chemical container and presses a button on the dispenser 21 to indicate that event. In a system in which each dispenser port 26-28 has a reservoir that holds the chemical received from a container, the data reader scans the indicia when an operator fills the reservoir from the container.

Figure 9:
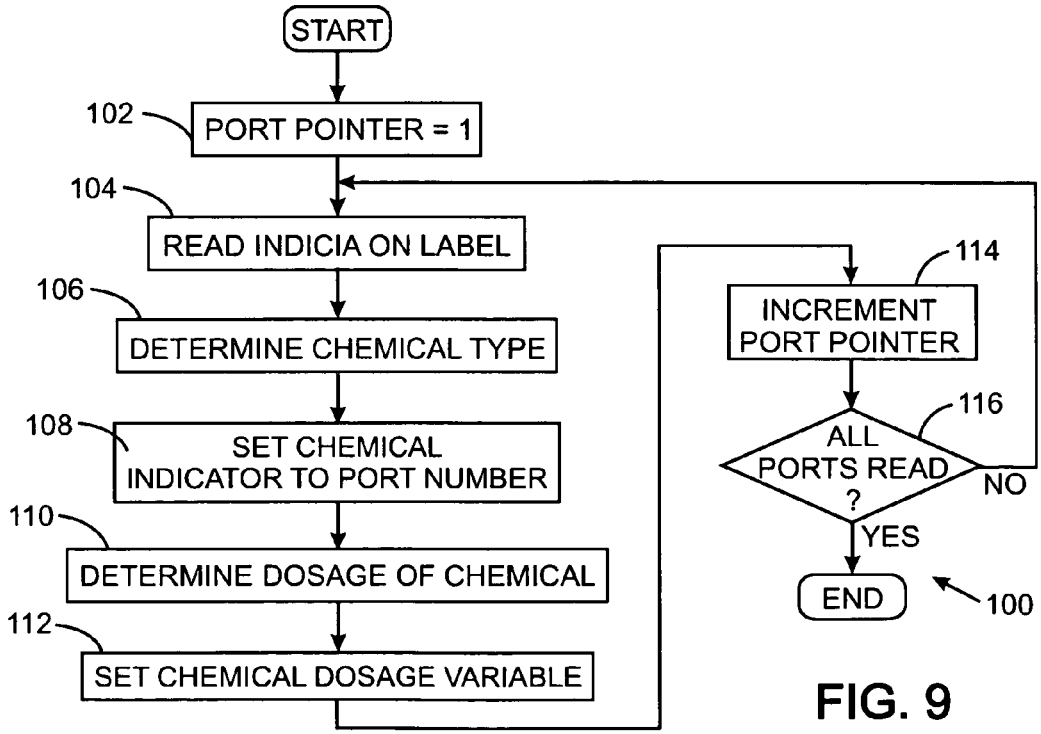
FIG. 9 is a flowchart of a software routine that is executed by the control circuit to configure the warewasher operation to properly dispense each chemical.

When it is desired to read the signals from the three data readers 33, 34 and 35, the microcomputer 38 executes a software routine 100 depicted in FIG. 9. That routine commences at step 102 by setting a variable, designated a Port Pointer, to one to indicate the first port 26 of the dispenser 21. Then, at step 104, the microcomputer reads the signal from the data reader for the indicated port, at this time the first data reader 33. The signal from that data reader is decoded at step 106 to extract the information indicating the type of chemical, e.g. detergent, rinsing agent or sanitizer, within the associated container. At step 108, that chemical type designation is stored within a table in the memory 41 to provide an indication of the chemical available at the first dispenser port 26.

Next at step 110, the microcomputer 38 determines the appropriate dose of this chemical to dispense during each operation of the warewasher. In one version of the present invention, the microcomputer 38 utilizes the indication of the particular type of chemical to address a look-up table within the memory 41 that contains a dose value for each commonly used type of chemical. For example, various types of detergent may require that different amounts be dispensed during each wash cycle of the warewasher 10. Even the same general type of detergent may come in different concentrations, which also require that different amounts be dispensed for optimum cleaning and economy. The dose value preferably is defined by a particular amount of time that the pump 58 for the first dispenser port 26 should be operated in order to dispense the proper amount of chemical. Alternatively, for dispensing systems 20 that utilize a radio frequency identification tag 96 on the container, the information obtained from that tag may indicate not only the type of chemical, but also its physio-chemical parameters, such as viscosity, density, and concentration. The concentration is used to address in a look-up table to determine the pump operating time. In other situations, the control system 36 may be configured with the proper dispenser pump operating interval for a detergent, rinsing agent or sanitizer that has a predefined concentration. When the same general type of chemical is found with a different concentration, the microcomputer 38 executes a preprogrammed equation to derive the proper pump operating time for that different concentration, based on the pump operating time for the predefined concentration. In either situation, the appropriate pump operating time for the particular chemical in the container inserted in the first port 26 is then stored at step 112 as a the value of a dose variable for that port. This completes the configuration of the first port 26 with the type of chemical and the chemical dose.

The software routine 100 then advances to step 114 at which the Port Pointer is incremented to read and process the indicia for the container in the next port. At step 116, the program then returns to step 104 to process that data. When all three ports 26-28 have been configured in this manner, the software routine 100 terminates and normal washing operation of the warewasher 10 commences. At that time the memory 41 contains a designation of which port 26-28 contains each type of chemical (detergent, rinsing agent and sanitizer) and the pump operating time for that port.

When the controller 37 gets to a point during the cleaning cycle at which detergent is to be dispensed into the cabinet 12, the microcomputer 38 accesses the table within memory 41 that specifies the type of chemical inserted into each port 26, 27 and 28 of the dispenser 21. Specifically, the microcomputer accesses a memory location that indicates the port into which a container of detergent has been inserted. That port designation determines which dispenser pumps 58, 64 or 66 to activate for the detergent. The table in memory 41 also specifies the amount of time that this pump should be operated to feed the proper dose of the detergent into the warewasher cabinet 12. The microcomputer 38 then activates the respective dispenser pump for that prescribed period of time. A similar operation is conducted at the appropriate times during the cleaning cycle to dispense the rinsing agent and the sanitizer from the dispensing system 20. Alternatively variable speed dispenser pumps 58, 64 or 66 could be employed and the dose of each chemical is controlled by varying the pump speed and thus the rate at which the chemical is supplied to the warewasher.

Therefore, the present system properly dispenses the different chemicals regardless of into which port 26, 27 or 28 the operator has inserted a container of a particular chemical. In other words, unlike previous systems in which a particular port was designated to always receive a container of a given chemical, detergent for example, a particular chemical may be placed into any port and the operation of the machine is automatically reconfigured to properly dispense that chemical. The present dispensing system also detects when the same chemical is placed into more than one dispenser ports 26-28, in which case the operator is alerted to that occurrence.

Furthermore, if the signals from a data readers 33-35 indicate the absence of a particular chemical that is critical to proper cleaning, an alarm annunciation is issued. In addition, operation of the warewasher may be suspended by the controller 37 until a container of that chemical is inserted into the dispensing system 20. It should be understood that not all of the different chemicals are essential to cleaning in all circumstances. A sanitizer typically only is required if the rinse water is below a defined temperature, e.g. 74° C., as water above that temperature will sanitize the kitchenware without requiring chemical augmentation. Therefore, operation of the warewasher 10 may continue after the supply of sanitizer is exhausted, as long as the rinse water is above the defined temperature.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. An apparatus for dispensing a chemical into a cleaning machine wherein the chemical is stored in a container that has data recorded in a radio frequency identification tag thereon, said apparatus comprising:

a dispenser port for receiving the chemical from the container;

a flow control device connected to the dispenser port and controlling flow of the chemical from the dispenser port to the cleaning machine;

a sensor for detecting when the container that is located at the dispenser port is empty;

a data reader that interrogates the radio frequency identification tag to obtain the data from the container which is located at the dispenser port, and that, when the container is detected to be empty, erases the data recorded in the radio frequency identification tag; and a controller connected to the data reader and operating flow control device in response to the data to control an amount of chemical that is dispensed.

2. The apparatus as recited in claim 1 wherein the flow control device is selected from a group consisting one of an electric motor for moving a metering and dispensing closure on the container, a pump, and a valve.

3. The apparatus as recited in claim 1 wherein the controller operates the flow control device to control an amount of chemical that is dispensed by controlling one of an amount of time that the chemical is dispensed, a rate at which the chemical is dispensed, and movement of a metering and dispensing closure on the container.

4. The apparatus as recited in claim 1 wherein the controller operates a given flow control device for an amount of time determined from a signal produced by the data reader.

5. An apparatus for dispensing a plurality of types of chemicals into a cleaning machine, wherein each chemical is stored in a container that has data recorded in a radio frequency identification tag thereon, said apparatus comprising:

a plurality of dispenser ports each for receiving a container to accept chemicals therefrom;

a plurality of flow control devices each associated with a different one of the plurality of dispenser ports and controlling flow of chemicals from the associated dispenser port to the cleaning apparatus;

a plurality of sensors each associated with a different one of the plurality of dispenser ports and detecting when the container located at the associated dispenser port is empty;

a plurality of data readers each associated with a different one of the plurality of dispenser ports, wherein each data reader interrogates a radio frequency identification tag to read data from a container received in the associated dispenser port and, when the container is detected to be empty, erases data recorded in that radio frequency identification tag; and a controller connected to the plurality of flow control devices and the data reader arrangement, and operating the plurality of flow control devices in response to the data read from each container to control amounts of each chemical that are dispensed.

6. The apparatus as recited in claim 5 wherein each of the plurality of flow control devices is selected from a group consisting of an electric motor for moving a metering and dispensing closure on the container, a pump, and a valve.

7. The apparatus as recited in claim 5 wherein the controller operates given flow control device for an amount of time determined from a signal produced by one of the plurality of data readers that is associated with the same one of the plurality of dispenser ports with which the given flow control device is associated.

8. The apparatus as recited in claim 5 wherein the controller operates the flow control device to control an amount of chemical that is dispensed by controlling one of an amount of time that the chemical is dispensed, a rate at which the chemical is dispensed, and movement of a metering and dispensing closure on the container.

9. A method for dispensing a chemical into a cleaning machine wherein the chemical is stored in a container that has data recorded in a radio frequency identification tag thereon, said method comprising:

receiving the chemical from the container located at a dispenser port;

reading data by interrogating the radio frequency identification tag on the container that is located at the dispenser port;

sensing when the container is empty;

operating a flow control device to control an amount of chemical that is dispensed from the dispenser port in response to the data read from the container; and when the container is empty, erasing data recorded in the radio frequency identification tag.

10. The method as recited in claim 9 wherein operating a flow control device controls one of an amount of time that the chemical is dispensed, a rate at which the chemical is dispensed, and movement of a metering and dispensing closure on the container.

* * * * *

UNITED STATES PATENT AND TRADEMARK OFFICE

CERTIFICATE OF CORRECTION

PATENT NO. : 7,654,421 B2
APPLICATION NO. : 11/444869
DATED : February 2, 2010
INVENTOR(S) : Chan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 770 days.

Signed and Sealed this

Twenty-third Day of November, 2010

David J. Kappos

David J. Kappos
*Director of the United States Patent and Trademark Office*